US005298321A

United States Patent [19]

Isoda et al.

[11] Patent Number: 5,298,321

[45] Date of Patent: Mar. 29, 1994

[54] RECYCLABLE VEHICULAR CUSHIONING MATERIAL AND SEAT

[75] Inventors: Hideo Isoda, Ootsu; Mitsuhiro Sakuda, Iwakuni; Yoshihiro Amagi, Osaka; Kenji Tanaka, Iwakuni; Kunio Kimura, Ootsu; Michio Kobayashi, Iwakuni; Tadaaki Hamaguchi, Iwakuni; Seiji Sawahara, Iwakuni, all of Japan

[73] Assignee: Toyo Boseki Kabushiki Kaisha, Osaka, Japan

[21] Appl. No.: 907,543

[22] Filed: Jul. 2, 1992

[30] Foreign Application Priority Data

| | | | |
|---|---|---|---|
| Jul. 5, 1991 | [JP] | Japan | 3-060639[U] |
| Feb. 26, 1992 | [JP] | Japan | 4-076040 |
| Feb. 27, 1992 | [JP] | Japan | 4-076217 |
| Feb. 27, 1992 | [JP] | Japan | 4-076218 |
| Mar. 16, 1992 | [JP] | Japan | 4-091939 |

[51] Int. Cl.[5] ..... D04H 1/58

[52] U.S. Cl. ..... 428/288; 428/362; 428/369; 428/373; 428/296; 428/297

[58] Field of Search ..... 428/297, 360, 362, 369, 428/373, 288

[56] References Cited

U.S. PATENT DOCUMENTS

| | | | |
|---|---|---|---|
| 4,172,174 | 10/1979 | Takagi . | |
| 4,795,668 | 1/1989 | Krueger et al. | 428/174 |
| 5,082,720 | 1/1992 | Hayes | 428/224 |
| 5,141,805 | 8/1992 | Nohara et al. | 428/296 |

FOREIGN PATENT DOCUMENTS

| | | |
|---|---|---|
| 0371807 | 6/1990 | European Pat. Off. . |

*Primary Examiner*—George F. Lesmes
*Assistant Examiner*—Chris Raimund
*Attorney, Agent, or Firm*—Wegner, Cantor, Mueller & Player

[57] ABSTRACT

A recyclable vehicular cushioning material which is thermoformed from a web composed of three-dimensionally crimped polyester fiber having a fineness lower than 45 denier per filament and an initial tensile strength (IS) higher than 30 g/d and heat-bonding fiber containing polyester elastomer, as heat-bonding component, which are mixed and dispersed and, if necessary, interlaced, said cushioning material having a layer whose bulk density is 0.02–0.06 g/cm$^3$.

6 Claims, 1 Drawing Sheet

RECYCLABLE VEHICULAR CUSHIONING MATERIAL AND SEAT

BACKGROUND OF THE INVENTION

1. Field of the Invention:

The present invention relates to a recyclable vehicular cushioning material and seat.

2. Description of the Prior Art:

Among the known vehicular cushioning materials is polyurethane. Polyurethane is in general use as a vehicular cushioning material because of its good durability, cushioning properties, and processability as well as its low price. However, polyurethane has a disadvantage of being combustible. Upon combustion, it gives off a large amount of toxic gases, which endanger passengers in the case of vehicular fire. To cope with this situation, polyurethane is incorporated with a halogen-containing flame retardant. This flame retardant, however, does not make polyurethane incombustible completely but gives off a large amount of toxic halogen gas once combustion starts. This is quite dangerous particularly in the case of fire in a tunnel or underpass.

Another disadvantage of polyurethane is that it becomes greatly deteriorated after use for a long period of time, and deteriorated polyurethane is usually disposed of because its reuse involves difficulties and a practical method for its recycling is still in the stage of investigation. The disposition of polyurethane is usually by incineration after collection by junk dealers. Outdoor incineration brings about air pollution with toxic gases (such as cyan gas). Incineration by an incinerator can remove toxic gases, but it is expensive because the incinerator is subject to corrosion by toxic gases. Therefore, polyurethane is usually disposed of by dumping in the site of land reclamation. Being a cellular material, polyurethane keeps the ground unstable. For this reason, a large amount of polyurethane is now left in an open space, and a very little of it is recycled at the present time.

Recently, a new vehicular cushioning material has appeared which is made with fibers to eliminate the stuffiness of seats. It is used for some deluxe cars. The fibers are natural fiber or synthetic fiber combined with an adhesive (such as polyurethane and rubber latex) for improved durability. It is anticipated that this cushioning material will follow the fate of polyurethane on account of its unique composition. Another new cushioning material is for the breathable seat designed to eliminate stuffiness. It is composed of three-dimensionally crimped thick polyester fibers bonded together with rubber latex. This cushioning material, too, will follow the fate of polyurethane because of its unique composition. Moreover, it involves a risk of candle effect (i.e. burning like candle) in the case of fire.

There is known a polyester fiber-based cushioning material in which three-dimensionally crimped polyester fibers are heat-bonded with low-melting non-elastomer copolyester fibers. This cushioning material has found use for mattresses because of its good moisture permeability (which alleviates stuffiness). Being thermoplastic, it may be regenerated by melting into fibers. Alternatively, it may be recovered in the form of monomer after methanolysis. Despite these advantages, it is not suitable for vehicular seats to be used under severe conditions because it is poor in permanent set resistance at high temperatures. In other words, it readily undergoes plastic deformation upon compression at 70° C. because the bonding material is amorphous and it also greatly undergoes plastic deformation because its body material is polyester fiber made by a conventional method and having a glass transition temperature lower than 70° C.

The covering of vehicular seats is usually made of nylon tricot, nylon moquette, polyvinyl chloride, and urethane-impregnated synthetic leather, which are superior in durability. The nylon covering is mostly disposed of together with the pad by incineration or land reclamation because its separation from the pad costs too much and it is difficult to collect it in such large quantities as to warrant the cost for recycling. (Nylon 6 can be recovered in the form of lactum after depolymerization and hence nylon fishing nets are collected for recovery.) Moreover, the covering for vehicular seats usually contains a halogen-based flame retardant so that it meets the requirements for flame retardance. Therefore, the covering of nylon, polyvinyl chloride, or polyurethane gives off a large amount of toxic cyan gas and halogen gas upon combustion, and these combustion gases are extremely dangerous in the case of vehicular fire. Their disposition by incineration is expensive if an adequate measure is to be taken to prevent air pollution. Therefore, they are often left or buried. The covering of polyester is supposed to be treated in the same manner as mentioned above if it is combined with a cushioning material of polyurethane or rubber.

Nothing has so far been proposed for the vehicular seat and its cushioning material having little stuffiness which are designed with safety and recyclability in mind.

SUMMARY OF THE INVENTION

It is an object of the present invention to provide a vehicular seat and its cushioning material which offer the following advantages.

- Absence of stuffiness which obviates the necessity of forced ventilation during use.
- High safety from accidental deaths by toxic combustion gases.
- Recyclability which obviates the necessity of disposition by incineration or land reclamation. (This contributes to the reduction of air pollution and global warming by combustion gas.)
- Good heat-resistance and cushion property retention.

Briefly, the present invention is embodied in a vehicular cushioning material which is thermoformed from a web composed of three-dimensionally crimped polyester fiber having a fineness lower than 45 denier per filament and an initial tensile strength (IS) higher than 30 g/d and heat-bonding fiber containing polyester elastomer as heat-bonding component, which are mixed and dispersed and, if necessary, interlaced, said cushioning material having a layer whose bulk density is 0.02–0.06 g/cm$^3$.

DETAILED DESCRIPTION OF THE INVENTION

Figure 1:
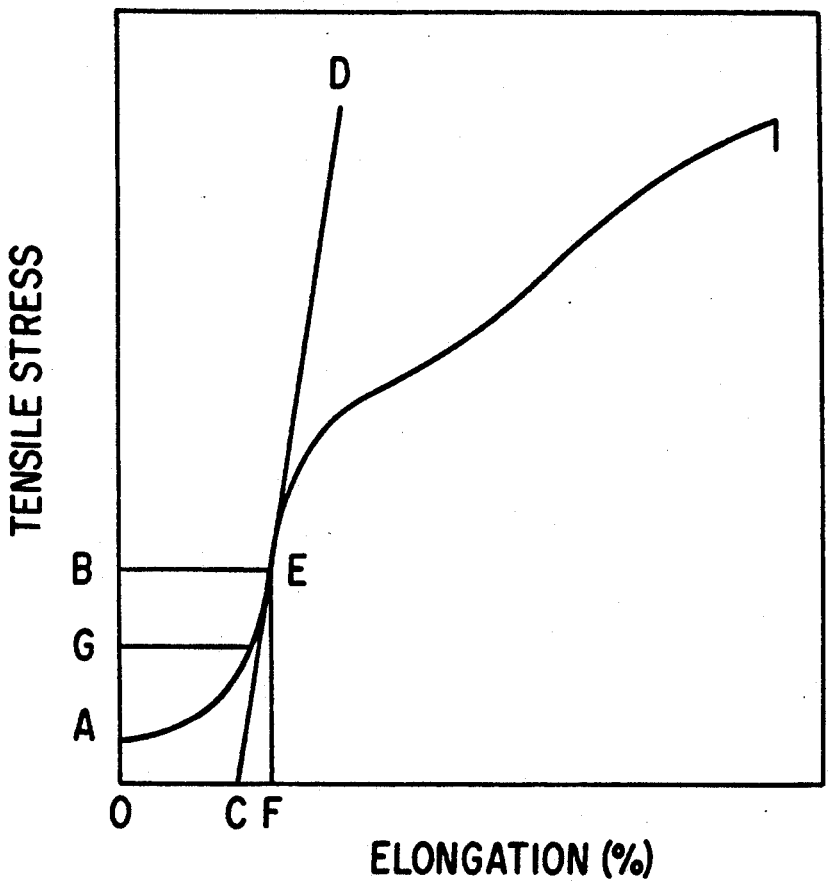
FIG. 1 is a stress-strain curve for the crimped polyester fiber.

According to the present invention, the vehicular seat and its cushioning material are entirely made of polyester fibers and hence they can be recycled by simple melting without the need of separating the covering from the pad. Alternatively, they can also be recovered after decomposition into monomers by any known method such as methanolysis. According to the present invention, more than 95%, preferably more than 99%, of the constituent is polyester, and the use of other materials than additives is limited. Preferred additives should not contain any halogen compound or nitrogen compound which gives off toxic gases in the case of fire. Moreover, those polyesters which are non-thermoplastic or infusible due to crosslinking should be excluded from the raw materials of the vehicular seat and its cushioning material, because they readily burn owing to the candle effect in the case of fire.

According to the present invention, the cushioning material is based on the three-dimensionally crimped fiber which is desirable on account of its high bulkiness. Crimping in the wavy form is preferable. The crimp index (Ci) should be higher than 15%; otherwise, the desired bulkiness is not obtained. The crimp number (Cn) should be greater than 10/inch; otherwise, the desired elastic (i.e. bouncing properties are not obtained. An adequate crimp index and crimp number should be selected according to the feel desired. For the soft layer, Cn should be on the low side and Ci should be on the high side. For the soft layer that needs elastic properties, both Cn and Ci should be on the high side. For the hard layer, Cn should be high. For the intermediate cushion layer, Ci should be higher than 15% and Cn should be higher than 10/inch. Ci higher than 25% and Cn in the range of 15–30/inch are desirable in the case where not only bulkiness but also resilience and hardness are required.

According to the present invention, the three-dimensionally crimped polyester fiber for the cushioning material is formed from polyethylene terephthalate (PET), polyubtylene terephthalate (PBT), polyethylene naphthalate (PEN), or polycyclohexylenedimethyl terephthalate (PCHDT), or a copolymer thereof, which are all recyclable. Of these polymers, PET, PEN, and PCHDT are preferable because of their good heat resistance.

According to the present invention, the three-dimensionally crimped polyester fiber for the cushioning material should have a fineness lower than 45 denier per filament and an initial tensile strength (IS) higher than 35 g/d, preferably higher than 40 g/d, and more preferably higher than 45 g/d. With an IS value lower than 35 g/d, the polyester fiber is liable to damage in the blending and opening process and also liable to decrease in IS during molding into the cushioning material at a high temperature. (Low IS values have an adverse effect on the elastic properties and permanent set resistance.) Owing to the high IS value, the polyester fiber withstands the stretching stress in the carding and opening process, undergoes little heat shrinkage in the post treatment, and retains the high permanent set resistance and elasticity.

According to the present invention, the three-dimensionally crimped polyester fiber for the cushioning material should have a heat resistance which satisfies the following condition.

$$IS \geqq (\Delta\epsilon + 0.6)^{-2.8} \times 10^3 + 10$$

(where $\Delta\epsilon$ denotes the elongation (%) at elastic limit, including the elongation of crimp, which is measured after dry-heat treatment at 200° C. for 5 minutes under no load.) In addition, the preferred material for the intermediate cushioning layer should be three-dimensionally crimped so that the Ci value is higher than 15% and the Cn value is higher than 10/inch. These conditions are necessary for the cushioning material to have very good permanent set resistance at high temperatures. The polyester fiber that does not satisfy the condition $IS \geqq (\Delta\epsilon + 0.6)^{-2.8} \times 10^3 + 10$ will be poor in permanent set resistance at high temperatures even though it has an IS value as high as 50 g/d. Moreover, it is desirable that the polyester fiber satisfy the condition $IS \geqq (\Delta\epsilon + 0.6)^{-2.8} \times 10^3 + 12$, in which case the polyester fiber retains more than 70% of the Ci value after 15 hours under a load of 5 mg/d at 70° C. It is more desirable that the polyester fiber satisfy the condition $IS \geqq (\Delta\epsilon + 0.6)^{-2.8} \times 10^3 + 15$, in which case the polyester fiber retains more than 80% of the Ci value after 15 hours under a load of 5 mg/d at 70° C.

Incidentally, $\Delta\epsilon$ after heat treatment and IS were measured according to the method described in JIS L-1063. The measurement gives a stress-strain curve as shown in FIG. 1. The stress between points A and O is due to the initial load. The stress at 100% elongation indicated by the straight line CD tangential to the maximum slope of the stress-strain curve is defined as the IS (g/d) after treatment. The elongation OF up to the elastic limit E deviating from the straight line CD is defined as the elongation ($\Delta\epsilon$) at elastic limit. The value is indicated as an average of 50 measurements.

According to the present invention, the three-dimensionally crimped polyester fiber for the cushioning material should have a specific cross section, either hollow or contour, that makes the polyester fiber bulky, stiff, and hard. Anisotropic cross-section is desirable which is obtained by asymmetric cooling. Hollow cross-section with three projections is most desirable.

According to the present invention, the three-dimensionally crimped polyester fiber should have a much higher crystallinity than any other known three-dimensionally crimped fiber so that it undergoes deformation little in heat treatment at as high as 200° C. This high crystallinity may be expressed in terms of a specific gravity higher than 1.39, preferably higher than 1.40.

Although there are no specific restrictions on the staple length, it should preferably be 40–120 mm so as to facilitate ordinary carding and opening and maintain entanglement.

According to the present invention, the cushioning material is produced by thermoforming from a web composed of the above-mentioned three-dimensionally crimped polyester fiber and the heat-bonding fiber containing polyester elastomer, as heat-bonding component, which are mixed and dispersed and, if necessary, interlaced. Since the heat-bonding fiber is made of polyester, the cushioning material is recyclable.

According to the present invention, the heat-bonding fiber should be of sheath-core type. (If the sheath (or the heat-bonding component) is made of a low-melting non-elastomeric material, such as an amorphous copolyester of terephthalic acid and isophthalic acid disclosed in Japanese Patent Kokai No. 154050/90, the cushioning material is considerably poor in permanent set resistance because of its strong tendency toward plastic deformation.) According to the present invention, the sheath component should preferably be a polyester elastomer having a melting point ($Tm_1$) of 160°–220° C., a peak temperature ($T\beta$) lower than −40° C. for the $\beta$-dispersion of tan $\delta$, and a rise temperature ($T\alpha cr$) higher than 50° C. for the $\alpha$-dispersion of tan $\delta$, and the core component should preferably be a non-elastomer polyester having a melting point ($Tm_2$) which is higher than $Tm_1$ by at least 20° C.

The polyester elastomer as used in the present invention denotes a block copolymer composed of hard segments and soft segments. The hard segments include, for example, PET, PBT, PEN, and PCHDT. The soft segments include, for example, polytetramethylene glycol (PTMG), polyhexamethylene glycol (PHMG), polypropylene glycol (PPG), and polycaprolactone (PCL). Their preferred combinations are, for example, PBT/PTMG, PEN/PTMG, PBT/PCL, and PBT/PPA.

PTMG as the soft segment should preferably have a molecular weight of 1000–3000. There is an optimum combination of the soft segments and hard segments which depends on their composition and the number of repeating units. The optimum combination meets the above-mentioned requirements—$T\beta$ lower than −40° C., preferably lower than −50° C., and $T\alpha cr$ higher than 50° C., preferably higher than 60° C., so that the fiber has good recovery after stretching at 70° C. The heat-bonding fiber with such bonding component is combined with the above-mentioned body material so as to produce the vehicular cushioning material having the desired properties. With $T\beta$ higher than −40° C., the cushioning material is poor in recovery; with $T\alpha cr$ lower than 50° C., the cushioning material is liable to plastic deformation.

According to the present invention, the polyester elastomer should have $Tm_1$ higher than 160° C.; otherwise, it is poor in heat resistance and long-term heat stability. Also, the polyester elastomer should have $Tm_1$ lower than 220° C.; otherwise, its soft segments are subject to deterioration and decomposition during the thermoforming of the cushioning material which is performed at a temperature higher than $Tm_1$ by at least 10° C. At such a high temperature, even the body material (the three-dimensionally crimped polyester fiber) decreases in IS, yielding the cushioning material poor in permanent set resistance. The preferred range of $Tm_1$ is from 170° C. to 210° C., at which the cushioning material exhibits good permanent set resistance.

According to the present invention, the heat-bonding fiber should be of sheath-core type, so that bonding takes place at all the points where the heat-bonding fibers come into contact with the body material. This structure disperses the force applied to the body material and the contact points absorb the force through their deformation. This prevents the body material from permanent set and improves the recovery of the body material. If the heat-bonding fiber is not of sheath-core type, bonding points will not be enough in number and strength to construct the satisfactory net-work structure. This leads to poor force dispersion and hence poor permanent set resistance.

The sheath/core ratio should preferably be from 10/90 to 90/10. If the sheath is less than 10%, the heat-bonding fiber does not produce sufficient bond points, which leads to poor force dispersion and poor permanent set resistance. Conversely, if the sheath is more than 90%, the heat-bonding fiber is poor in dimensional stability, which causes trouble during processing. The most preferable range is from 30/70 to 60/40. The core may be eccentric or composed of two components. In this case, the heat-bonding fiber is bulky due to three-dimensional crimping. The heat-bonding fiber to be used for the cushioning material of the present invention may have either mechanical crimps or three-dimensional crimps, so long as it can be formed into a web by uniform dispersion in the blending and opening process.

According to the present invention, the core of the heat-bonding fiber is made of non-elastomer polyester. With an elastomer alone, the heat-bonding fiber is poor in dimensional stability and crimpability and presents difficulties in the web forming owing to its rubbery resilience which prevents uniform blending and opening. If it were not for the core, the heat-bonding fiber will form a coarse net-work structure with the body material, yielding a soft cushioning material. This problem is solved by making the core from a non-elastomer polyester. If the non-elastomer polyester as the core component has $Tm_2$ which is lower than $Tm_1$ of the sheath component by at least 20° C., the core (which forms the net-work structure with the body material) is heated beyond the crystal melting point at the time of thermoforming. This causes the orientation of fiber to disappear, resulting in poor permanent set resistance. This problem is solved if $Tm_2$ is higher by at least 20° C., preferably at least 30° C. The core component should be PET, PBT, etc. which is capable of melt spinning at a temperature low enough to prevent the deterioration of the elastomer. A crystalline component is desirable because of its weak tendency toward thermoplastic deformation. A copolymer containing a large amount of amorphous polyethylene isophthalate is not desirable because it is liable to plastic deformation and hence is poor in permanent set resistance.

The heat-bonding fiber should have a low heat shrinkage, so that it forms bond points uniformly at the time of thermoforming. The higher the heat shrinkage, the more the delamination is liable to occur. The heat shrinkage by dry heating at 130° C. should be lower than 20%, preferably lower than 15%. In addition, the heat-bonding fiber should have a high IS so that it undergoes less stretch deformation in the opening process. This leads to a low shrinkage in the web and reduces the chance of delamination. The preferred IS 15 g/d.

The heat-bonding fiber in the present invention is not specifically limited in the fineness per filament. Any fineness will suffice so long as the heat-bonding fiber is capable of blending with and dispersion into the body material in the blending and opening process. If the body material has a fineness of 6–15 denier, the heat-bonding fiber should have a fineness greater than 3 denier so that it is capable of uniform dispersion. An adequate fineness should be established by taking into account the ability to produce as many bond points as possible and the capability of uniform blending. It is 2–4 denier for the 6-denier body material, or 4–8 denier for the 13-denier body material.

The component for the heat-bonding fiber may be optionally incorporated with a delustering agent, pigment, antioxidant, UV light absorber, flame retardant, etc. in amounts not harmful to recycling.

The cushioning material of the present invention should preferably contain the body material in an amount equal to 30–95 wt %. With an amount less than 30 wt %, the cushioning material does not have the desired bulkiness. With an amount in excess of 95%, there will not be sufficient bond points required for elastic recovery and dimensional stability. The most preferable amount is 50–80 wt %. With an amount in this range, the elastomer forms sufficient bond points which disperse the force uniformly in the cushioning material, alleviating the damage which individual fibers would otherwise experience.

The cushioning material of the present invention is formed by thermoforming from the above-mentioned three-dimensionally crimped polyester fiber and heat-bonding polyester fiber, which are mixed and dispersed in the above-mentioned mixing ratio, and interlaced, if necessary.

The mixing may be accomplished, for example, by placing on the body material fiber the heat-bonding fiber (in the form of sheet) in the desired mixing ratio, and sending them to the opener for preliminary opening. The thus obtained staple fibers are fed to a card to prepare a web. (It is possible to prepare a web by the aid of air-lay. In this case, the resulting web is composed of individual staple fibers which are placed on top of the other and hence is less liable to delamination.) As many webs as necessary to achieve the desired basis weight are laminated one over another. Webs may be temporarily bonded to one another by heating their surfaces with infrared rays. The laminated webs may be interlaced by needlepunching to adjust the bulk density and also to facilitate handling. The laminated webs finally undergo thermoforming by compression in such a manner that the formed article has a lower bulk density than that obtained by molding.

Subsequently, the laminated webs, needlepunched webs, or primary thermoformed webs are further laminated and made into a single body by thermoforming using a mold. Thus there is obtained a cushioning material desired.

According to the most preferred embodiment of the present invention, the preliminary thermoforming is carried out such that the formed article has a bulk density which is from ½ to ⅔ of the intended bulk density. After cooling, the preliminarily formed article is thermoformed again by compression to the intended bulk density at a temperature which is higher than 70° C. but lower than the $Tm_1$ by at least 30° C. This two-step thermoforming yields the cushioning material having greatly improved recovery at 70° C. The conceivable reason for this is that the second thermoforming gives rise to a structure, which is not completely crystalline but functions as the cross-linking points to join soft segments one another, greatly improving the permanent set resistance. This reasoning is based on the fact that a small endothermic peak ($Tm_c$), which is lower than the melting point by at least 70° C., is noticed in addition to $Tm_1$ in the cushioning material which has undergone heat treatment twice. It is considered that this endothermic peak is due to the melting of crystals in the heat-bonding component.

The cushioning material of the present invention should have at least one layer which has a bulk density of 0.02–0.06 g/cm$^3$ and exhibits the cushioning function. In the case where the cushioning material is placed directly on a base, the cushioning material may be composed of a single layer having a bulk density of 0.02–0.06 g/cm$^3$. However, it is desirable to make the cushioning material from several layers—a surface layer having a bulk density of 0.008–0.03 g/cm$^3$ for soft feel, an intermediate layer having a bulk density of 0.02–0.06 g/cm$^3$ for adequate resilience and form retention, and a base layer having a bulk density of 0.06–0.15 g/cm$^3$ for form retention and supporting the cushion through the cushioning layer and springs.

The surface layer is designed so as to provide a soft feel and an adequate degree of bottoming. With a bulk density lower than 0.008 g/cm$^3$, the surface layer is too soft to prevent bottoming-out, making the sitter feel tired. Conversely, with a bulk density higher than 0.03 g/cm$^3$, the surface layer feels hard, causing the sitter to feel the rebound of the cushioning layer, although the bottoming-out is small and the sitter does not feel tired soon. The intermediate layer should be designed taking into account the function of the elastic body which insulates the vibration of vehicles and supports the sitter. With a bulk density lower than 0.02 g/cm$^3$, the intermediate layer does not provide sufficient rebound resilience to support the sitter's weight, making the sitter feel bottoming-out strongly. Conversely, with a bulk density higher than 0.06 g/cm$^3$, the intermediate layer is superior in rebound resilience but is poor in the ability to insulate vibration. The base layer should be designed taking into account the function to support the cushion body. With a bulk density lower than 0.06 g/cm$^3$, the base layer is too soft to support the cushion layer, causing the cushioning material to collapse. With a bulk density higher than 0.15 g/cm$^3$, the base layer is too hard to cushion the upper two layers against the sitter's weight, accelerating the permanent set of the upper two layers. Incidentally, if the base layer has a high bulk density, the cushioning material may not easily collapse in the burning test. In this case, it is desirable that the cushioning material be incorporated with flame retardant polyester fibers which contain phosphorus in an amount of 300–1000 ppm, preferably 500–5000 ppm.

It is desirable that the surface layer account for 10–30 wt %, the intermediate layer, 60–80 wt %, and the base layer, 5–30 wt %.

The above-mentioned fundamental design may be modified such that each layer is divided into two or more layers differing in bulk density which are arranged sequentially in the order of bulk density or one layer is sandwiched by identical two layers.

The cushioning material of the present invention has both breathability and moisture permeability. Therefore, it does not substantially feel stuffy unlike polyurethane even in the absence of forced ventilation. Presumably, this is due to the recovery of the cushioning material from compression which pumps out moist warm air and pumps in outside fresh air.

The cushioning material of the present invention should usually conform to the standard for automotive flame retardance when tested according to the method of FM MVSS302. However, it may fail to conform if the base layer has a high bulk density or the heat-bonding fibers are not uniformly distributed.

The cushioning material of the present invention is flame retardant presumably because the low-melting heat-bonding component greatly decreases in melt viscosity when exposed to high temperatures as in the case where decomposition is promoted by the phosphorus compound incorporated into ordinary flame retardant fiber, and the low-viscosity melt easily drips, destroying the structure of the nearby high-melting polyester and thereby preventing combustion from spreading. In addition, the cushioning material is highly safe even in the case of fire because it only gives off combustion gases such as carbon dioxide and hydrocarbons which have a low toxicity index (calculated by dividing the amount of combustion gas generated by the lethal dose (mg/10 L) by inhalation for 5–10 minutes).

This effect is not produced if the bonding component contains rubber or incombustible materials. Any part which does not readily burn functions as a candlewick, spreading combustion, which constitutes a serious danger.

The seat of the present invention may be made flame retardant if it is provided with a covering of polyester fiber, preferably flame-retardant polyester fiber. The flame retardance of the seat is ensured by using an inner lining fabric of flame-retardant fiber.

According to the preferred embodiment of the present invention, the flame-retardant polyester fiber is one which contains a phosphorus-containing flame retardant or a phosphorus-containing ester-forming compound copolymerized therein which does not give off toxic combustion gases. Examples of such polyester fiber are disclosed in Japanese Patent Kokai Nos. 8239/76 and 7888/80 and Japanese Patent Publication No. 41610/80. Alternatively, the desired flame retardance may be achieved by incorporating combustible polyester fiber with a phosphorus-containing flame retardant. The amount of phosphorus should be more than 500 ppm, preferably in the range of 1000–10000 ppm.

According to the preferred embodiment of the present invention, the cushioning material has an improved permanent set resistance when the three-dimensionally crimped polyester fiber as the body material thereof has an IS value greater than 30 g/d. With an IS value smaller than 30 g/d, the crimped polyester fiber is liable to plastic deformation and the crimped polyester fiber is poor in permanent set resistance at 70° C. Moreover, it is desirable that the IS value and $\Delta\epsilon$ satisfy the condition $IS \geqq (\Delta\epsilon+0.6)^{-2.8}\times 10^3+8$; otherwise, the crimped polyester fiber is poor in permanent set resistance. It is considered that the crimped polyester fiber is improved in permanent set resistance when it has both adequate hardness and toughness which are represented in terms of $\Delta\epsilon$ and IS, respectively. For better results, the IS and $\Delta\epsilon$ should satisfy the condition $IS \geqq (\Delta\epsilon+0.6)^{-2.8}\times 10^3+10$, preferably the condition $IS \geqq (\Delta\epsilon+0.6)^{-2.8}\times 10^3+12$. The cushioning material produces its desirable effect when it is formed from the above-mentioned body material fiber and heat-bonding fiber.

The three-dimensionally crimped polyester fiber as the body material for the cushioning material of the present invention is produced in the following manner which is given as an example. The three-dimensional crimping may be accomplished by asymmetric cooling or composite spinning. If the asymmetric cooling is carried out in such a manner that the fiber is not given a high degree of asymmetry but is given heat resistance and durability by means of drawing under high tension at a high temperature, the resulting cross-sectional anisotropy is too low to produce the desired crimping. Conversely, with an excessive degree of cross-sectional anisotropy, it is impossible to impart a high tension at the time of drawing and hence it is only possible to obtain polyester fiber having a low IS value. The asymmetric cooling should be performed to give the cross-sectional anisotropy which is regarded as adequate when the difference ($\delta\Delta n$) in birefringence between the cooled side and the opposite side is in the range of 0.003–0.005.

The thus obtained filaments (which are not yet drawn) are wound up or collected without winding, and then they undergo stretching. Stretching for PET is carried out in multiple steps. Stretching in the first step should be 0.7–0.75 times the maximum draw ratio (MDR) at a temperature higher than the glass transition point (Tg) and lower than 100° C. Deviation from this range prevents stretching with an adequate draw ratio in the second and third steps. Stretching in the second step should be 0.80–0.85 times the MDR at 120°–180° C., preferably 150°–170° C. Deviation from this range prevents stretching with a high tension at a high temperature in the third step. Stretching in the third step should be 0.9–0.95 times the MDR at a temperature lower than the crystal melting point by 5°–20° C. Finally (in the fourth step), the stretched fiber undergoes relaxation (less than 1%), or preferably, the stretched fiber is cooled to Tg, with the fiber length kept constant, to complete the structure. The known conventional method lacks this fourth step disclosed in this invention. Without the fourth step, the stretched fiber loses its tension, which results in decrease in cross-sectional anisotropy and IS. The fourth step increases the tension to such an extent that the conventional fiber readily breaks on account of its uneven diameter. Therefore, it is necessary to impart the cross-sectional anisotropy while keeping minimum the unevenness in fiber diameter at the time of spinning and stretching. The stretched fiber thus obtained exhibits the three-dimensional crimp due to elastic recovery upon removal of tension. Subsequently, the stretched fiber is cut in desired length and subjected to the heat treatment which makes crimps show, or the stretched fiber is cut into staples after the heat treatment to make crimps show. This heat treatment should preferably be carried out in two steps. In the first step, the stretched fiber is heated at about 160° C. in the substantial absence of tension. The stretched fiber becomes greatly crimped in spite of the drawing at a high temperature under a high tension. In the second step, the crimped fiber undergoes heat setting at about 200° C. under the substantially restrained condition. The heat treatment to make crimps show is responsible for the three-dimensionally crimped fiber having good heat resistance and durability. The three-dimensionally crimped fiber produced according to the method of the present invention differs from the known conventional one in that the former has a smaller bend at the secondary yielding point in the stress-strain curve than the latter.

The heat-bonding fiber for the cushioning material of the present invention is produced in the following manner which is given as an example. The heat-bonding fiber can be obtained by any known method for composite spinning. The sheath component is melted at 180°–270° C. and the core component is melted at 250°–295° C., and the spinning temperature is higher than the melting point of the core component by 10° C. or more, preferably 15° C. or more. In the case where $Tm_1 \geqq 180°$ C., it is desirable that the distance between the spinneret and the point of convergence be greater than 5 meters to avoid sticking. The collected filaments may be cooled by application of a finish after separation into individual filaments.

Then the filaments are stretched at a draw ratio of 0.75–0.8 times the MDR in a hot bath at 60° C. at which sticking does not take place. After optional heat treatment at a temperature at which sticking does not take place, the stretched filaments are crimped and cut into staples. (The heat treatment may be carried out after cutting.) The heat treatment is desirable because it reduces shrinkage. Since the elastomer-based filaments show a weak tendency toward sticking, it is desirable to apply a finish which helps opening at the time of carding. It is also desirable to apply a heat-resistant finish because the thermoforming is performed by heating and melting at a temperature within a certain range, with the upper limit being 5° C. above the $Tm_1$ of the sheath component and the lower limit being 30° C. below the $Tm_1$ of the sheath component.

According to the present invention, the cushioning material is obtained by forming webs from the three-dimensionally crimped polyester fiber as the body material and the heat-bonding polyester fiber by mixing and dispersion, making a plurality of the webs into a sheet by lamination, needlepunching, or preliminary thermoforming, and thermoforming a plurality of the laminated sheets in two steps using a mold. The following is an example of a preferred method of thermoforming the cushioning material of the present invention.

A first web for the soft layer is placed on the female mold for thermoforming. (This web is composed of the heat-bonding fiber having a fineness of 2–4 denier and the three-dimensionally crimped polyester fiber as the body material having a fineness of 1–10 denier, preferably 4–8 denier, and a Ci value and coefficient of friction on the low side, with their mixing ratio being from 5:95 to 30:70 by weight.) A second web for the intermediate layer having the cushioning function is placed on the first web. (This web is composed of the heat-bonding fiber having a fineness of 3–8 denier and the three-dimensionally crimped polyester fiber as the body material having a fineness of 6–45 denier, preferably 8–30 denier, and Ci and Cn values on the high side, with their mixing ratio being from 10:90 to 40:60 by weight, needlepunched or thermoformed under compression so that the bulk density is 0.01–0.03 g/cm$^3$.) A third layer for the base layer is placed on the intermediate layer. (This web is composed of the heat-bonding fiber having a fineness of 3–8 denier and the three-dimensionally crimped polyester fiber as the body material having a fineness of 10–45 denier, preferably 10–30 denier, and Ci and Cn values on the high side, with their mixing ratio being from 10:90 to 50:50 by weight, needlepunched or thermoformed under compression so that the bulk density is 0.03–0.10 g/cm$^3$.) According to the most desirable embodiment of the present invention, the laminated webs are compressed by the male mold to such an extent that the bulk density is ½ to ⅔ of the desired one and then thermoformed by melting. After cooling, the compressed webs are compressed to a desired thickness and heated again at a temperature which is higher than 70° C. but lower than the $Tm_1$ by at least 30° C. Thus there is obtained an integrally molded cushioning material. Incidentally, the thermoforming by melting should preferably be carried out by passing a hot gas from the male mold to the female mold, with the temperature of the hot gas being higher than the melting point of the heat-bonding component by 5°–20° C. If it is desirable that the surface layer have a low bulk density, the object is achieved by temporarily thermoforming under compression the intermediate layer and the base layer using a separate mold and integrally thermoforming them with the surface layer. Thermoforming at an excessively high temperature will greatly decrease the IS of the body material, which leads to poor permanent set resistance. In the case where deep drawing is necessary, it is possible to repeat the steps of thermoforming which also serve as post heat treatment. The thermoforming by melting should last for 2–10 minutes, preferably 3–5 minutes. The post heat treatment should last for 5–30 minutes, preferably 10–15 minutes, depending on the temperature. The mold should have a porosity of 10–50%.

The integrally thermoformed cushioning material may have any average bulk density; but it should preferably have a bulk density of 0.02–0.06 g/cm$^3$ for the effective weight reduction.

The cushioning material produced as mentioned above is made into a vehicular seat by finishing with a covering, wadding layer (inner lining fabric), and optional cushioning layer. The assembly is attached to the seat frame. Incidentally, it is also possible to integrally thermoform the covering and inner lining fabric placed under the soft layer. The covering, wadding (inner lining fabric), and optional cushioning material should be made of thermoplastic polyester fiber, preferably flame-retardant one. Any incombustible or infusible organic matter should not be used because of their liability to candle effect.

The invention will be described in more detail with reference to the following examples.

The physical quantities $Tm_1$, $Tm_2$, $Tm_c$, $T\beta$, $T\alpha cr$, IS, and $\Delta\epsilon$ used in the present invention were measured according to the following methods.

(1) $Tm_1$, $Tm_2$, and $Tm_c$

Measured with a differential thermal analyzer (model TA50 or DSC50) made by Shimadzu Corporation. The melting peak temperature was obtained by raising the temperature at a rate of 20° C./min.

(2) $T\beta$ and $T\alpha cr$

Measured with Vibron (model DDV-II) made by Orientec Co., Ltd., at 110 Hz by raising the temperature at a rate of 1° C./min. $T\beta$ is the peak temperature for the $\beta$-dispersion of tan $\delta$ (tan $\delta = E''/E'$, where $E''$ is loss modulus and $E'$ is storage modulus), and $T\alpha cr$ is the rise temperature for the $\alpha$-dispersion which corresponds to the temperature for transition from the rubber-elastic region to the melt region (or the temperature after rising at the intersection with the base line at the intermediate between the lowest point and highest point in the rubber-elastic region at 0°–30° C.).

(3) IS of polyester fiber in the cushioning material

The polyester fiber (body material) alone is taken out of the cushioning material by cutting the heat-bonding fiber carefully. The fineness (denier) of the polyester fiber is calculated from its specific gravity and its sectional area (obtained from the photograph of the cross section). An initial load is established according to the fineness. A stress-strain curve is drawn according to the method provided in JIS L-1063, and the IS is obtained from the stress-strain curve.

(4) $\Delta\epsilon$ of polyester fiber in the cushioning material $\Delta\epsilon$ is obtained from the stress-strain curve mentioned above in (3). It is the elongation up to the point at which the tangent of maximum slope (drawn for the measurement of IS) departs from the stress-strain curve. (Expressed in terms of an average of 50 measurements.)

EXAMPLES AND COMPARATIVE EXAMPLES

(1) Preparation of heat-bonding component

A polyester-ether block copolymer elastomer (polyester elastomer) was prepared in the known method by polycondensation from dimethyl terephthalate (DMT), 1,4-butanediol (1,4-BD), and polytetramethylene glycol (PTMG), together with a catalyst and antioxidant in small quantities. The resulting polyester elastomer was pelletized, followed by vacuum drying at 40° C. for 48 hours. The pellets were used for the heat-bonding component. Table 1 shows the formulation and characteristic properties of the polyester elastomer.

TABLE 1

| Run No. | A-1 | A-2 | A-3 | A-4 | A-5 |
|---|---|---|---|---|---|
| Hard segment | | | | | |
| Acid | DMT | DMT | DMT | DMT | DMI/DMT |
| Charge (g) | 645 | 485 | 966 | 453 | 621/932 |
| Glycol | 1,4-BD | 1,4-BD | 1,4-BD | 1,4-BD | EG |
| Charge (g) | 449 | 339 | 673 | 316 | 496 |
| Soft segment | | | | | |
| Component | PTMG | PTMG | PTMG | PTMG | — |
| Mol. wt. | 2000 | 3000 | 1000 | 2000 | — |
| Charge (g) | 1328 | 1497 | 995 | 1556 | — |
| Properties | | | | | |
| Tβ (°C.) | −47 | −51 | −30 | −47 | — |
| Tacr (°C.) | 62 | 52 | 88 | 39 | — |
| $Tm_1$ (°C.) | 189 | 187 | 193 | 158 | 130 |

For the purpose of comparison, low-melting polyester was prepared by polycondensation from DMT, dimethylisophthalate (DMI), and ethylene glycol (ED), together with a small amount of catalyst. Table 1 shows the formulation and characteristic properties of the polyester.

(2) Preparation of heat-bonding fiber

Composite filaments were prepared by spinning through a spinneret having four holes, from the heat-bonding component for sheath, which was melted at 220° C. and extruded at a through-put of 3 g/min, and PBT or PET for the core, which was melted at 260° C. or 280° C. and extruded at a through-put of 3 g/min, with the spinning temperature being 265° C. or 285° C. To prevent sticking, the four filaments were separated from one another for oiling, and then they were collected again and taken up at a rate of 700 m/min. Thus there were obtained unstretched filaments. The filaments were stretched at 0.8 times the MDR, followed by heat treatment at 70° C. The stretched filaments were doubled up to 2000 denier, followed by application of a finish and mechanical crimping by a crimper. The crimped filaments were finally cut into staples (64 mm long). Table 2 shows the characteristic properties of the staples.

TABLE 2

| Run | B-1 | B-2 | B-3 | B-4 | B-5 | B-6 | B-7 |
|---|---|---|---|---|---|---|---|
| Heat-bonding component | A-1 | A-2 | A-3 | A-4 | A-1 | A-2 | A-5 |
| Core component | PBT | PBT | PBT | PBT | PET | PET | PET |
| $Tm_2$ (°C.) | 230 | 230 | 230 | 230 | 265 | 265 | 265 |
| Heat-bonding fiber | | | | | | | |
| Sheath/core | 50/50 | 50/50 | 50/50 | 50/50 | 50/50 | 50/50 | 50/50 |
| Denier | 4.8 | 5.0 | 4.9 | 4.9 | 4.8 | 4.9 | 5.0 |
| Strength, g/d | 3.5 | 3.4 | 3.4 | 2.6 | 3.8 | 3.7 | 3.5 |
| Elongation, % | 48 | 50 | 51 | 63 | 46 | 51 | 53 |
| IS, g/d | 17 | 16 | 16 | 13 | 27 | 25 | 28 |
| Shrinkage (130° C.), % | 4 | 5 | 5 | 15 | 12 | 13 | 18 |

(3) Preparation of body material

PET having an IV of 0.63 was spun at 285° C. from a C-type spinneret or YU-type spinneret at a through-put of 4–6 g/min per hole. The emergent filaments were quenched at the position 30 mm right under the spinneret by blowing air at a rate of 2 m/s. The cooled filaments were taken up at a rate of 1080 m/min. The unstretched filaments were stretched in four steps. In the first step, 0.7 times the MDR in a hot bath at 80° C.; in the second step, 0.85 times the MDR at 160° C.; in the third step, 0.95 times the MDR at 220° C.; and in the fourth step, the filament temperature was lowered below the Tg while the filament length was kept constant. The stretched filaments were released from tension so that they exhibited elastic crimping. The crimped filaments were cut into staples (64 mm long). The staples were opened and heated at 160° C. so that they exhibited crimping. The crimped staples were compressed to such an extent that the bulk density was 0.05 g/cm$^3$. After heat treatment at 200° C., there was obtained three-dimensionally crimped polyester fiber as the body material. This polyester fiber has the characteristic properties as shown in Table 3.

For the purpose of comparison, three-dimensionally crimped polyester fiber was prepared in the same manner as mentioned above, except that stretching in the first step was carried out at 0.8 times the MDR and the second and subsequent steps were omitted. This polyester fiber has the characteristic properties as shown in Table 3.

TABLE 3

| Run No. Example No. (Comparative Example No.) | C-1 1 | C-2 2 | C-3 3 | C-4 (1) |
|---|---|---|---|---|
| Spinning conditions | | | | |
| Throughput, g/min | 4 | 6 | 6 | 6 |
| Spinneret | C-type | YU-type | C-type | C-type |
| Stretching conditions | 4 steps | 4 steps | 4 steps | 1 step |
| Properties of body material | | | | |
| Denier | 6.5 | 13 | 13.2 | 4.8 |
| Strength | 5.4 | 4.8 | 5.0 | 4.2 |
| Elongation | 20 | 16 | 20 | 45 |
| IS | 59 | 50 | 58 | 26 |
| Ci, % | 31 | 30 | 33 | 32 |
| Cn, /in. | 16 | 18 | 12 | 15 |
| Sp. Gr. | 1.405 | 1.405 | 1.400 | 1.382 |
| Section Properties after relaxation at 200° C. | | | | |
| Denier | 6.5 | 13.1 | 13.3 | 15.4 |
| Strength | 5.2 | 4.7 | 4.8 | 3.6 |
| Elongation | 22 | 18 | 21 | 49 |
| IS | 60 | 50 | 58 | 23 |
| Δε, % | 3.8 | 8.2 | 3.2 | 3.0 |
| Equation* | 25.8 | 12.3 | 33.8 | 37.7 |
| Ci, % | 30 | 31 | 34 | 28 |

TABLE 3-continued

| Run No. | C-1 | C-2 | C-3 | C-4 |
|---|---|---|---|---|
| Example No. (Comparative Example No.) | 1 | 2 | 3 | (1) |
| Cn, /in. | 15 | 18 | 13 | 12 |

*$(\Delta\epsilon + 0.6)^{-2.8} \times 10^3 + 10$ (4) Preparation of a flat simplex cushion layer The heat-bonding fiber and body material prepared as mentioned were mixed in a mixing ratio of from 10:90 to 30:70 by weight. The mixture was preliminarily opened by an opener and then opened by a card. The opened mixture was compressed into a 10-cm thick web having a basis weight of 300–1500 g/m$^2$. This web was thermoformed by hot air for 5 minutes. The temperature of the hot air was higher than the melting point of the heat-bonding component by 10° C. After cooling, the thermoformed sample having a basis weight of 1500 g/m$^2$ was compressed to a thickness of 5 cm and heat-treated again at 130° C. for 15 minutes, followed by cooling. Thus there was obtained a single-layered sample for evaluation. For the purpose of comparison, a sample was prepared by compressing to a thickness of 5 cm in one step, followed by thermoforming for 5 minutes. The thus obtained samples were allowed to stand for one day and then tested for permanent set resistance at 70° C., 50% compression rebound, rebound, and flame retardance (provided by MVSS302). The results are shown in Table 4. For the purpose of comparison, a card web was prepared from 100% body material and the web was needlepunched for interlacing so that a bulk density of 0.03 g/cm$^3$ was achieved. The needlepunched web was impregnated with a natural rubber latex containing a small amount of vulcanizing agent and catalyst. After air drying, the impregnated web was heated at 130° C. for 30 minutes. Thus there was obtained a flat single-layered sample. This sample was also evaluated in the same manner as mentioned above. Polyurethane as a blank sample was also evaluated. The results are shown in Table 4.

The following methods were employed to evaluate the flat single-layered samples.

[1] Apparent bulk density

Each sample is cut into a square piece measuring 10×10 cm. The volume of the piece is calculated from the thickness measured at four points. The division of the weight by the volume gives the apparent bulk density. The result is expressed in terms of an average of three measurements.

[2] Permanent set resistance at 70° C.

Each sample is cut into a square piece measuring 15×15 cm. The piece is kept compressed to half the original thickness at 70° C. (dry heat) for 22 hours. Permanent set resistance is defined as hi/ho×100 (%), where ho is the thickness of the compressed piece measured before heat treatment, and hi is the thickness of the compressed piece measured after recovery (standing for one day for strain relaxation). The result is expressed in terms of an average of three measurements.

[3] 50% compression rebound

Each sample is cut into a square piece measuring 20×20 cm. The piece is compressed between compression boards, 150 mm in diameter, to half the original thickness, using a Tensilon. The rebounding force (in kg) exerted by the compressed piece is measured. The result is expressed in terms of an average of three measurements.

[4] Rebound

Measured according to the rebound test method provided by JIS K-6382.

TABLE 4

| | D-1 | D-2 | D-3 | D-4 | D-5 | D-6 | D-7* | D-8 | D-9 | D-10 | D-11* | D-12* | D-13 |
|---|---|---|---|---|---|---|---|---|---|---|---|---|---|
| Heat-bonding fiber | B-1 | B-2 | B-3 | B-4 | B-5 | B-6 | B-7 | B-2 | B-2 | B-2 | latex | — | B-2 |
| Body material | C-2 | C-2 | C-2 | C-2 | C-2 | C-2 | C-4 | C-1 | C-3 | C-4 | C-4** | *** | C-4 |
| H/B mixing ratio | 30/70 | 30/70 | 30/70 | 30/70 | 30/70 | 30/70 | 30/70 | 10/90 | 30/70 | 30/70 | 40/60 | 0/100 | 30/70 |
| Basis weight, g/m$^2$ | 1500 | 1500 | 1500 | 1500 | 1500 | 1500 | 1500 | 300 | 1500 | 1500 | 1500 | — | 1500 |
| Temperature at first treatment, °C. | 200 | 100 | 205 | 200 | 200 | 200 | 180 | 200 | 200 | 200 | 130 | — | 200 |
| Bulk density after 1st treatment, g/cm$^3$ | 0.015 | 0.015 | 0.015 | 0.015 | 0.015 | 0.015 | 0.03 | 0.003 | 0.015 | 0.015 | 0.05 | 0.05 | 0.03 |
| Post treatment for crystallization | yes | yes | yes | yes | yes | yes | no | no | yes | yes | — | — | no |
| Bulk density after post treatment, g/cm$^3$ | 0.03 | 0.03 | 0.03 | 0.03 | 0.03 | 0.03 | — | 0.03 | 0.03 | — | — | — | — |
| Permanent set resistance at 70° C., % | 74 | 78 | 63 | 65 | 70 | 73 | 10 | — | 62 | 43 | 23 | 85 | 30 |
| 50% compression rebound force, kg | 30 | 28 | 33 | 32 | 40 | 42 | 35 | — | 36 | 28 | 21 | 40 | 25 |
| Rebound | 65 | 60 | 68 | 63 | 75 | 78 | 60 | — | 68 | 60 | 55 | 82 | 43 |
| Flame retardance | pass | pass | pass | pass | pass | pass | pass | — | pass | pass | fail | fail | pass |
| $Tm_c$ (temp. °C.) | 103 | 100 | 105 | 96 | — | — | none | — | — | 100 | — | — | none |

*Comparison,
**Nyban,
***Expanded polyurethane

It is noted from Table 4 that the simplex layer prepared according to the preferred embodiment of the present invention is superior in permanent set resistance and meets the requirements for flame retardance. By contrast, the comparative example (D-7) disclosed in Japanese Patent Kokai No. 154050/90 is extremely poor in permanent set resistance, and the similar comparative example (D-11) disclosed in Japanese Patent Kokai No. 138669/79 is poor in permanent set resistance and is also very poor in flame retardance (the sample almost burnt up).

(5) Preparation of the cushioning material

Preliminary forming was performed on the soft layer, intermediate layer, and base layer which are single layers prepared by one-step thermoforming as mentioned above. The preliminary forming consists of compressing each layer between porous male and female molds (having a porosity of 30%) and blowing hot air (130° C.) for 5 minutes from the male mold. The soft layer (D-8) was compressed until its bulk density increased from 0.003 g/cm$^3$ to 0.005 g/cm$^3$. The intermediate layer (D-2) was compressed until its bulk density increased from 0.015 g/cm$^3$ to 0.020 g/cm$^3$. The base layer (D-6) was sliced in half and compressed until its bulk density increased from 0.015 g/cm$^3$ to 0.060 g/cm$^3$. After trimming, the three layers were placed on top of the other in the female mold, and they were compressed by the male mold until they came into close contact with one another. Hot air (200° C.) was blown for 5 minutes in the same manner as mentioned above. After cooling, compression was repeated until the final density was reached. Hot air (130° C.) was blown again for 15 minutes. Thus there was obtained an integrally formed cushioning material (E-1) of multilayered structure which is made up of the seat cushion and the seat back. Comparative samples (E-2 and E-3) were prepared by the one-step process from D-10 (with a comparative body material) and D-7 (disclosed in Japanese Patent Kokai No. 154050/90). As many webs as necessary to have a basis weight of 2550 g/m$^2$ were laminated, and the laminated webs were compressed in a mold (for integral forming) until the final density is obtained. Hot air (200° C.) was forced through the compressed webs for 5 minutes. The thus obtained seat cushions were evaluated. The results are shown in Table 5. For the purpose of comparison, a commercial polyurethane cushion was also evaluated.

The cushioning material produced as mentioned above was provided with a covering and inner lining fabric, (both made of flame-retardant polyester fiber), and the resulting seat was mounted on a seat frame for the driver of a passenger car. The sample seat was evaluated by six monitors for stuffiness, comfort, and resilience, at the beginning of use and after use for six months. Their average rating is indicated by A, B, and C. The results of evaluation are also shown in Table 5.

It is noted from Table 5 that the cushioning material of the present invention is superior to the known cushioning material made of fibers in permanent set resistance, flame retardance, and safety (with a low combustion gas toxicity index). It is also noted that the cushioning material can be used for a seat which is improved over a polyurethane seat in stuffiness, resilience, comfort, and weight.

After use, the sample seats (E-1 and E-4) were dismantled and freed of metal parts. The cushioning material was pressed at 260° C. and then coarsely crushed. After vacuum drying, the crushed material was pelletized again at 280° C. The pellets were mixed with virgin PET pellets in a 50/50 mixing ratio. After drying at 285° C., the mixture was extruded for spinning in the usual way. It was possible to obtain filaments (unstretched) without any trouble such as breakage and kneeing.

As demonstrated in Examples, the present invention provides a vehicular cushioning material and seat which offer the following advantages.

Absence of stuffiness which obviates the necessity of forced ventilation during use.

High safety from accidental deaths by toxic combustion gases.

Recyclability which obviates the necessity of disposition by incineration or land reclamation.

Good permanent set resistance required for use on vehicles.

TABLE 5

| | E-1 | E-2* | E-3* | E-4 | E-5* |
|---|---|---|---|---|---|
| Cushioning material | D2, D6, D8 | D-10 | D-7 | D-6 | PU |
| Processing method | Multi-step | One-step | One-step | Multi-step | Foaming |
| Structure | Multi-layer | One-layer | One-layer | One-layer | One-layer |
| Cushioning material | | | | | |
| Bulk density (g/cm$^3$) | | | | | |
| Soft layer | 0.01 | — | — | — | — |
| Intermediate layer | 0.035 | 0.030 | 0.035 | 0.031 | 0.052 |
| Base layer | 0.063 | — | — | — | — |
| Body material in cushioning material | | | | | |
| $\Delta\epsilon$ | 8.4 | 2.0 | 2.1 | 7.9 | — |
| IS | 38 | 24 | 21 | 42 | — |
| $Tm_c$ (°C.) | yes (102) | none | none | yes (102) | — |
| Permanent set resistance at 70° C. | 75 | 34 | 10 | 68 | 85 |
| 50% rebound force, kg | 30 | 25 | 32 | 38 | 41 |
| Flame retardance | pass | pass | pass | pass | fail |
| Combustion gas toxicity index | 4.9 | 5.0 | 5.1 | 5.0 | 6.7 |
| Seat | | | | | |
| Stuffiness | | | | | |
| start | A | A–B | A–B | A | C |
| end | A | B | B–C | A | C |
| Sitting comfort | | | | | |
| start | A | A–B | A–B | A | B |
| end | A | B–C | C | A | B |
| Resilience | | | | | |
| start | A | A | A | A | A |
| end | A | B–C | C | A | A |

*Comparative Examples

Weight reduction which leads to energy saving and exhaust gas control.

The cushioning material of the present invention will also find use as bedding, furniture, and mattress. Additional uses include padding, heat and sound insulator, and extensible non-woven fabric.

What is claimed is:

1. A vehicular cushioning material which is thermoformed from a web composed of (A) three-dimensionally crimped polyester fiber (1) having a fineness lower than 45 denier per filament, (2) having an initial tensile strength (IS) higher than 35 g/d, (3) having a crimp index (Ci) higher than 15%, (4) having a crimp number (Cn) greater than 10/inch, and (5) satisfying the following condition:

$$IS \geqq (\Delta\epsilon + 0.6)^{-2.8} \times 10^3 + 10$$

where $\Delta\epsilon$ denotes the elongation (%) at the elastic limit, including the elongation of crimp, which is measured after dry-heat treatment at 200° C. for 5 minutes under no load; and (B) a heat-bonding fiber of the sheath-core type containing p2 (1) a polyester elastomer comprising a block copolymer as the heat-bonding component, and (2) a non-elastomeric core, which are mixed and dispersed and, optionally interlaced; said cushioning material having a layer whose bulk density is 0.02–0.06 g $cm^3$.

2. A vehicular cushioning material as defined in claim 1, wherein the heat-bonding fiber contains a heat-bonding component which has an endothermic peak detectable by differential thermal analysis at other points than the melting point which are within a range of 70° C. below the melting point.

3. A vehicular cushioning material as defined in claim 1, wherein the heat-bonding fiber is of sheath/core type, with the sheath component being made of a polyester ether which has a melting point ($Tm_1$) higher than 160° C. and lower than 220° C., a peak temperature ($T\beta$) lower than −40° C. for the $\beta$-dispersion of tan $\delta$, and a rise temperature ($T\alpha cr$) higher than 50° C. for the $\alpha$-dispersion of tan $\delta$, with the core component being made of a non-elastomer polyester having a melting point ($Tm_2$) which is higher than $Tm_1$ by at least 20° C.

4. A vehicular cushioning material as defined in claim 1, which is composed of three or more layers including a soft layer with a bulk density of 0.008–0.02 g/$cm^3$, an intermediate layer with a bulk density of 0.02–0.06 g/$cm^3$, and a base layer with a bulk density of 0.06–0.15 g/$cm^3$.

5. A vehicular seat which is formed by covering with a surfacing material of polyester the cushioning material defined in claim 1.

6. A vehicular seat as defined in claim 5, wherein the surfacing material is made of flame-retardant polyester.

* * * * *